US007987604B2

(12) United States Patent
Zernec

(10) Patent No.: US 7,987,604 B2
(45) Date of Patent: Aug. 2, 2011

(54) JIG FOR USE IN CUTTING SYNTHETIC SHINGLES AND TILES

(75) Inventor: Daniel Max Zernec, Ortonville, MI (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 12/619,967

(22) Filed: Nov. 17, 2009

(65) Prior Publication Data

US 2011/0113723 A1 May 19, 2011

(51) Int. Cl.
*G01B 3/14* (2006.01)
*B26B 27/00* (2006.01)

(52) U.S. Cl. ..... 33/32.2

(58) Field of Classification Search ..... 33/32.2, 33/32.1, 32.3, 427, 443, 464, 562, 566
See application file for complete search history.

(56) References Cited

U.S. PATENT DOCUMENTS 637,373 A * 11/1899 Crawford et al. ..... 33/427
648,535 A * 5/1900 Senden et al. ..... 33/443
684,142 A * 10/1901 Ward ..... 269/87.1
935,067 A * 9/1909 Taylor ..... 33/42
2,580,263 A * 12/1951 Wooten ..... 33/32.2
2,813,710 A * 11/1957 Angle ..... 266/58
2,901,832 A * 9/1959 Hulen ..... 33/443
4,717,109 A * 1/1988 Johnston ..... 248/441.1
4,924,594 A * 5/1990 Fernandes ..... 33/483
5,143,490 A 9/1992 Kopras
5,323,823 A 6/1994 Kopras
5,813,805 A 9/1998 Kopras
5,902,080 A 5/1999 Kopras
6,048,260 A 4/2000 Kopras
6,434,848 B1 * 8/2002 Gordon et al. ..... 33/528
6,808,785 B1 10/2004 Friedman et al.
7,141,200 B2 11/2006 MacKinnon et al.
7,141,201 B2 11/2006 Kim et al.
2008/0022542 A1 * 1/2008 Brosmith et al. ..... 33/562

* cited by examiner

*Primary Examiner* — Christopher W Fulton
(74) *Attorney, Agent, or Firm* — Paul & Paul

(57) ABSTRACT

A jig is provided for use in cutting synthetic shingles or tiles, as comprising a table and a clamping bar, with fasteners securing the clamping bar to the table for clamping a shingle or tile between the table and the bar, with the bar being used as a guide for sliding a cutting tool therealong, at any of an infinite number of angles, for making an infinite number of angled cuts to the shingle or tile. The table may be constructed having a base with a frame, and a removable and replaceable insert.

6 Claims, 4 Drawing Sheets

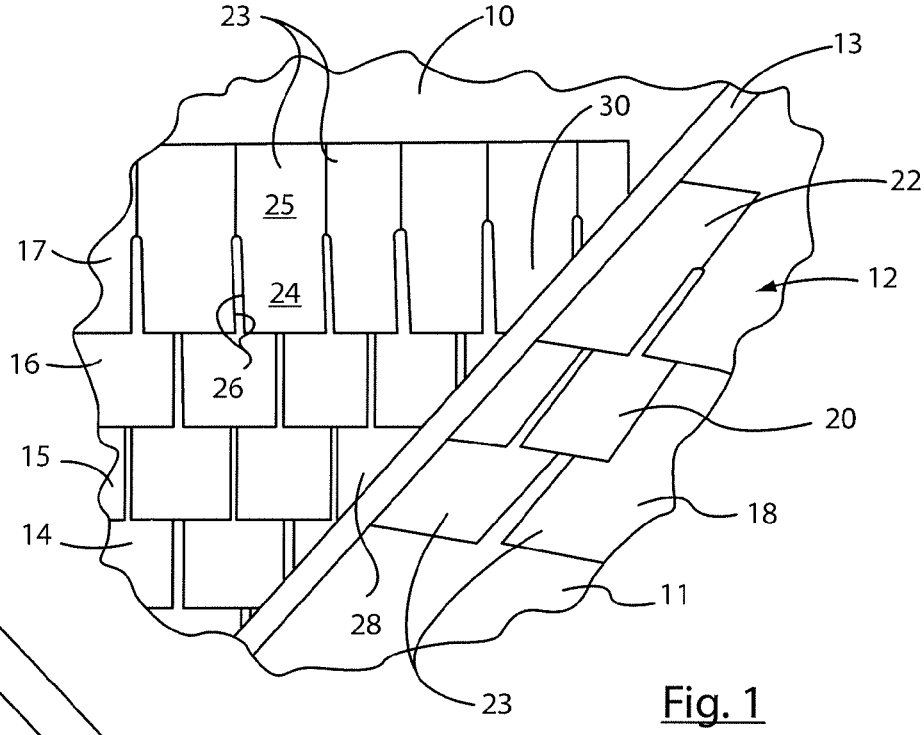
Fig. 1
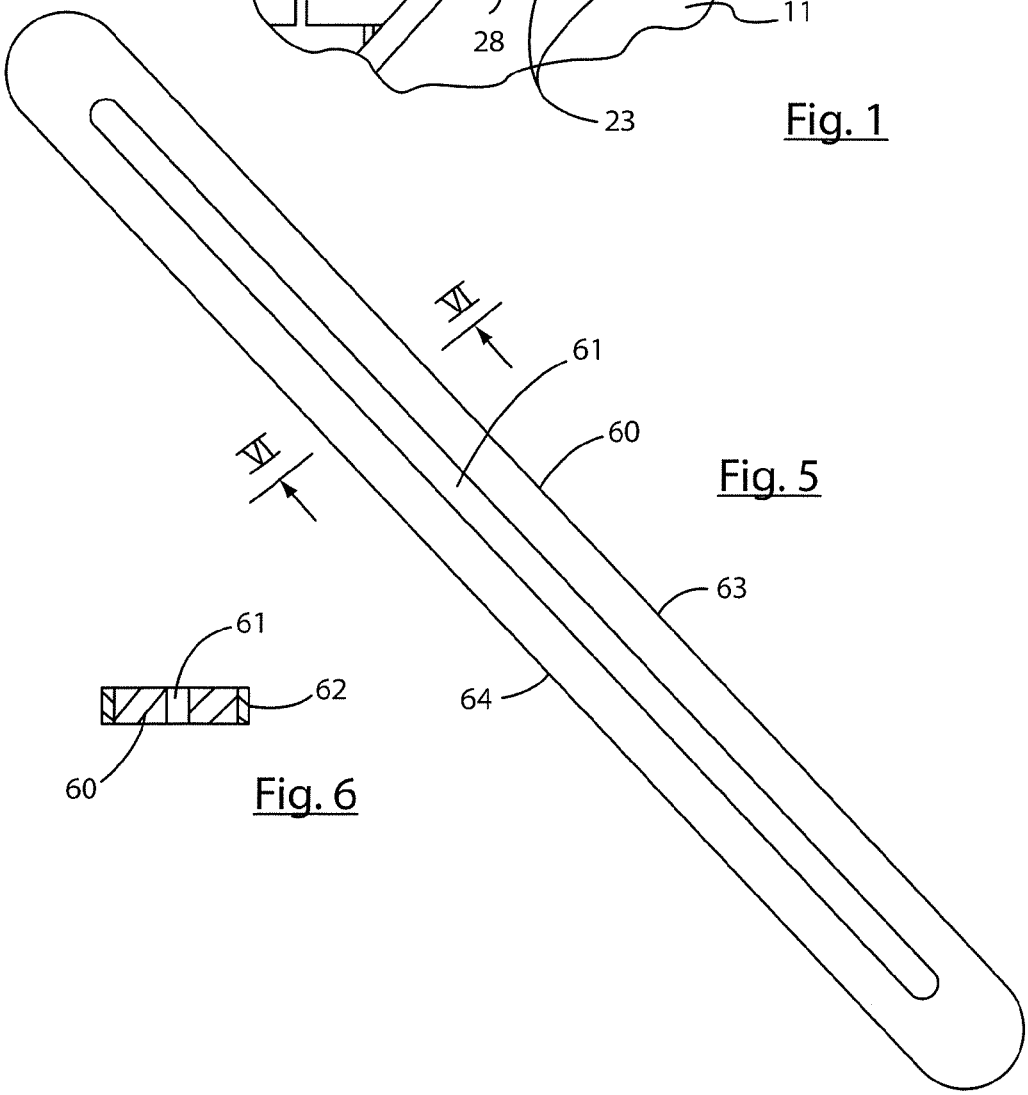
Fig. 5
Fig. 6

JIG FOR USE IN CUTTING SYNTHETIC SHINGLES AND TILES

BACKGROUND OF THE INVENTION

Recent developments in the roofing field have led to the making of synthetic shingles and tiles that simulate natural materials, for example, slate.

Such shingle or tiles can be manufactured with recesses, lines, grooves and seemingly random appearances, to yield aesthetically pleasing surface and edge characteristics, enhancing the ability of the synthetic shingles or tiles to appear to be natural materials.

Additionally, the benefits of making such synthetic shingles or tiles enable the cost-effective production of shingles or tiles, as well as producing shingles or tiles that generally are of less weight than comparable natural materials, in that they can be manufactured using different materials for a core, than the materials that are used on weather-exposed portions of the shingle or tiles when such shingles or tiles are installed on a roof. Such weather-exposed portions of the shingles or tiles can also have various desirable characteristics included in their manufacturing processes, such as algae-resistant qualities, flame retardant qualities, ultraviolet light resistant qualities, etc.

In general, when shingles or tiles are installed on a roof, they are laid up on a roof in courses, with their tab portions being weather-exposed, and the butt or headlap portions of the shingles or tiles being covered by shingles or tiles in a next-overlying course. Also, in applying shingles or tiles to a roof, the same are staggered laterally, so that lateral edges of shingles or tiles in an underlying course are not vertically aligned with lateral edges of shingles or tiles in a next-overlying course. At ends of courses of shingles or tiles it is usually necessary to cut the end-most shingles or tiles to size. Additionally, where there are intersecting surfaces of a roof, the shingles or tiles must generally be cut at an angle, for example, at the location of valleys where surfaces intersect, or for custom cuts in irregular areas, such as around vents, pipes, chimneys and other shapes.

THE PRESENT INVENTION

The present invention is directed to providing a jig for use in cutting synthetic shingles and tiles, such that the jig may be used in situ, on a roof, as the roof is being covered with shingles or tiles, and which is sufficiently light and compact that it can readily be carried up to a roof for use.

SUMMARY OF INVENTION

The present invention therefore provides a jig for use in cutting synthetic shingles or tiles, that comprises a table with a plurality of elongate slots therein and a clamping bar, likewise elongate, and having an elongate or longitudinal slot therein. Fasteners are used to fasten the clamping bar to the table, with the fasteners passing through the elongate slot in the clamping bar and into elongate slots in the table, with the positioning of the clamping bar being slideably adjustable prior to being clamped in place by the fasteners, such adjustability being throughout an infinite number of angular positions of the clamping bar.

Accordingly it is an object of this invention to provide a jig as described immediately above, enabling the cutting of shingles or tiles throughout an infinite number of clamping positions of the bar on the table.

It is another object to accomplish the above object, whereby a cutting tool may be slid along an edge of the clamping bar once the clamping bar is fastened in position to cut the shingle or tile that is clamped between the clamping bar and the table to a desired angular cut.

A further object of this invention is the object set forth above, wherein the table is comprised of a frame and a removable insert.

An additional object of this invention is in providing slip-resistant pads on the lower surface of the table, to keep it from sliding off a sloped roof.

Other objects and advantages of the present invention will be readily apparent upon a reading of the following brief descriptions of the drawing figures, the detailed descriptions of the preferred embodiments and the appended claims.

BRIEF DESCRIPTIONS OF THE DRAWING FIGURES

FIG. 1 is a fragmentary perspective view of two intersecting surfaces of a roof, with shingles or tiles cut in accordance with this invention being laid up thereon.

FIG. 5 is a top view of the clamping bar in accordance with this invention.

FIG. 6 is a transverse sectional view taken through the clamping bar of FIG. 5, generally along the line VI-VI of FIG. 5.

DETAILED DESCRIPTION OF THE PREFERRED EMBODIMENTS

Figure 2:
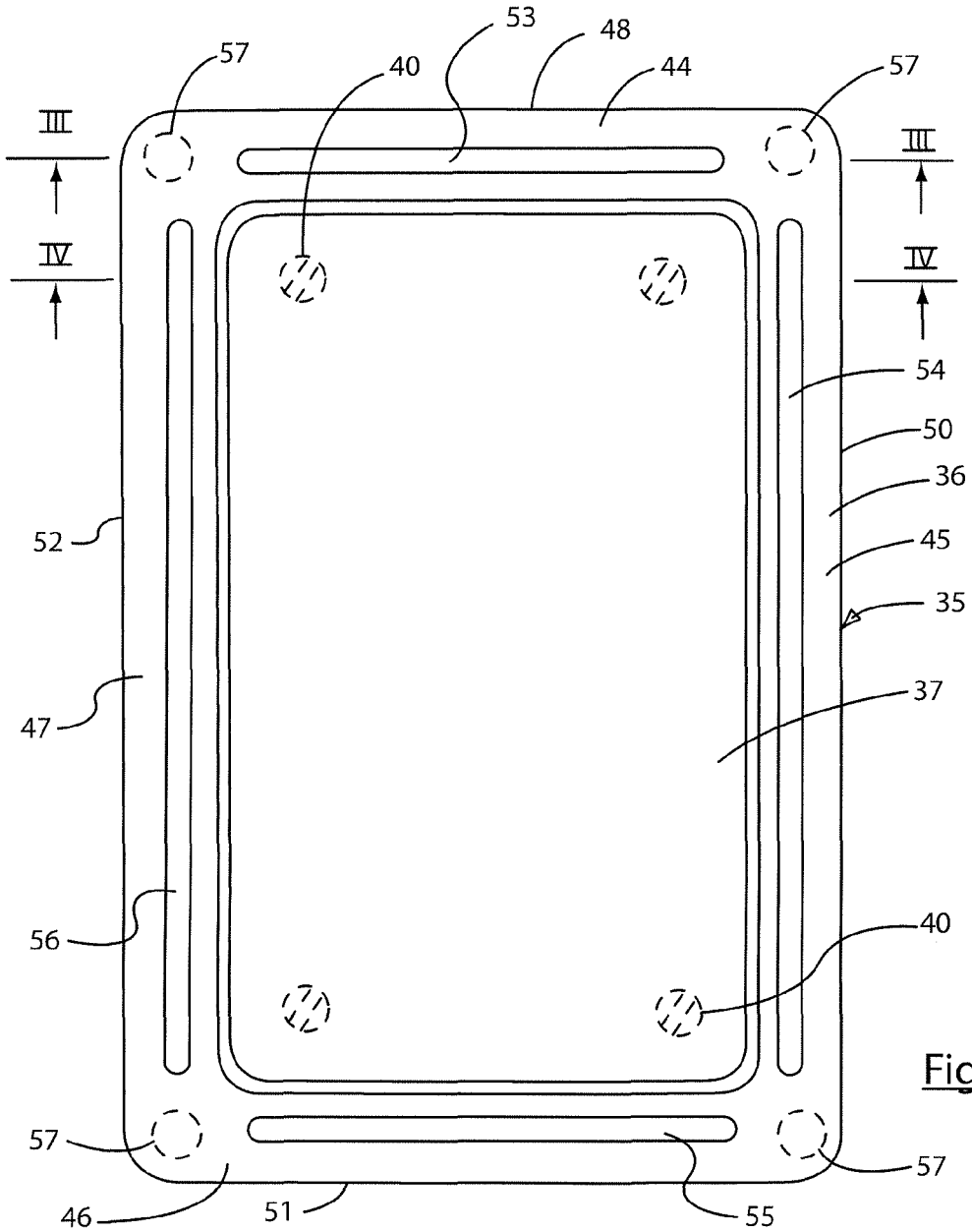
FIG. 2 is a top view of a table of a jig in accordance with this invention.
Figure 3:
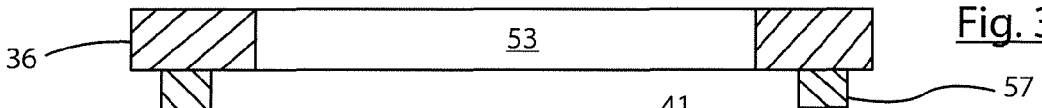
FIG. 3 is a transverse sectional view of the table of FIG. 2, taken generally along the line III-III of FIG. 2.

Referring now to the drawings in detail, reference is first made to FIG. 1, wherein two intersecting surfaces 10 and 11 of a roof 12 are illustrated, meeting in a valley 13. A plurality of courses 14, 15, 16, 17, 18, 20 and 22 of shingles 23 are illustrated, with the shingles 23 being laid up side-by-side, in a conventional manner.

Each of the shingles 23 has a tab portion 24 at its lower end and a headlap or butt portion 25, and, as is conventional, when the shingles are laid up in courses, with tab portions 24 of shingles in an overlying course covering the butt or headlap portions 25 of shingles in a next-underlying course. The shingles may be constructed to have cutback lateral edges 26, such that when adjacent shingles are laid up on a roof, the cutback edges 26, in pairs, will form slots between tab portions of adjacent shingles.

It will be apparent that some of the shingles, such as those shingles 28 and 30 illustrated in FIG. 1 will need to be cut at an angle where their edges approach the valley 13.

The jig of this invention has its table 35 illustrated in FIG. 2, and comprises a generally rectangular frame 36 with a removable and replaceable insert 37 attached to the base 38 of the frame 36 by suitable screw type fasteners 40 that are preferably counter-sunk into the base 38. Four such fasteners 40 are illustrated in FIG. 2.

Figure 4:
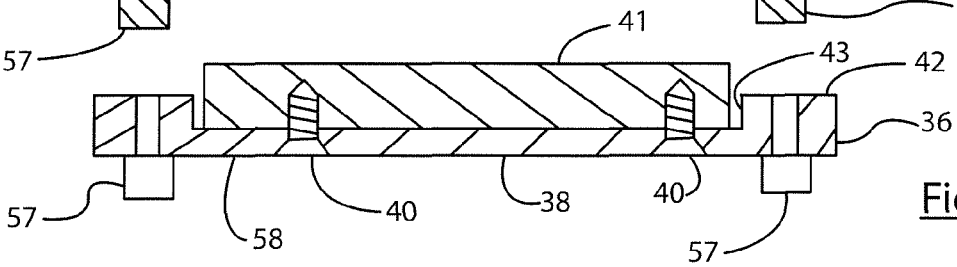
FIG. 4 is a transverse sectional view of the table of FIG. 2, taken generally along the line IV-IV of FIG. 2.

The insert 37 has an upper surface 41 that protrudes above the upper surface 42 of the frame, for receipt of a shingle that is to be cut against the surface 41. The insert 37 preferably sits in a recess 43 in the base 38, as shown in FIG. 4.

The frame 36 has four sides, 44, 45, 46 and 47 ending in edges 48, 50, 51 and 52, respectively.

Parallel to the edges 48, 50, 51 and 52 and disposed inboard of those edges are a plurality of elongate slotted holes 53, 54, 55 and 56.

A plurality of slip-resistant pads of rubber or similar slip-resistant material 57 are carried on the bottom surface 58 of the base 38, being preferably adhesively secured thereto, for anti-slip disposition of the table 35 on a surface, such as a sloped roof surface while the jig is being used.

With reference to FIGS. 5 and 6, it will be seen that a clamping bar 60 is provided, having an elongate slotted hole 61 therein. The clamping bar 60 may be constructed of a lightweight material, such as plastic or the like, or of metal. If it is constructed of plastic, it will preferably have metal, preferably steel edges 62 adhered thereto, for wear resistance, to accommodate a shingle or tile cutter being slid therealong, with one of the edges 63 or 64 being used as a guide, for sliding the cutting tool therealong.

Figure 7:
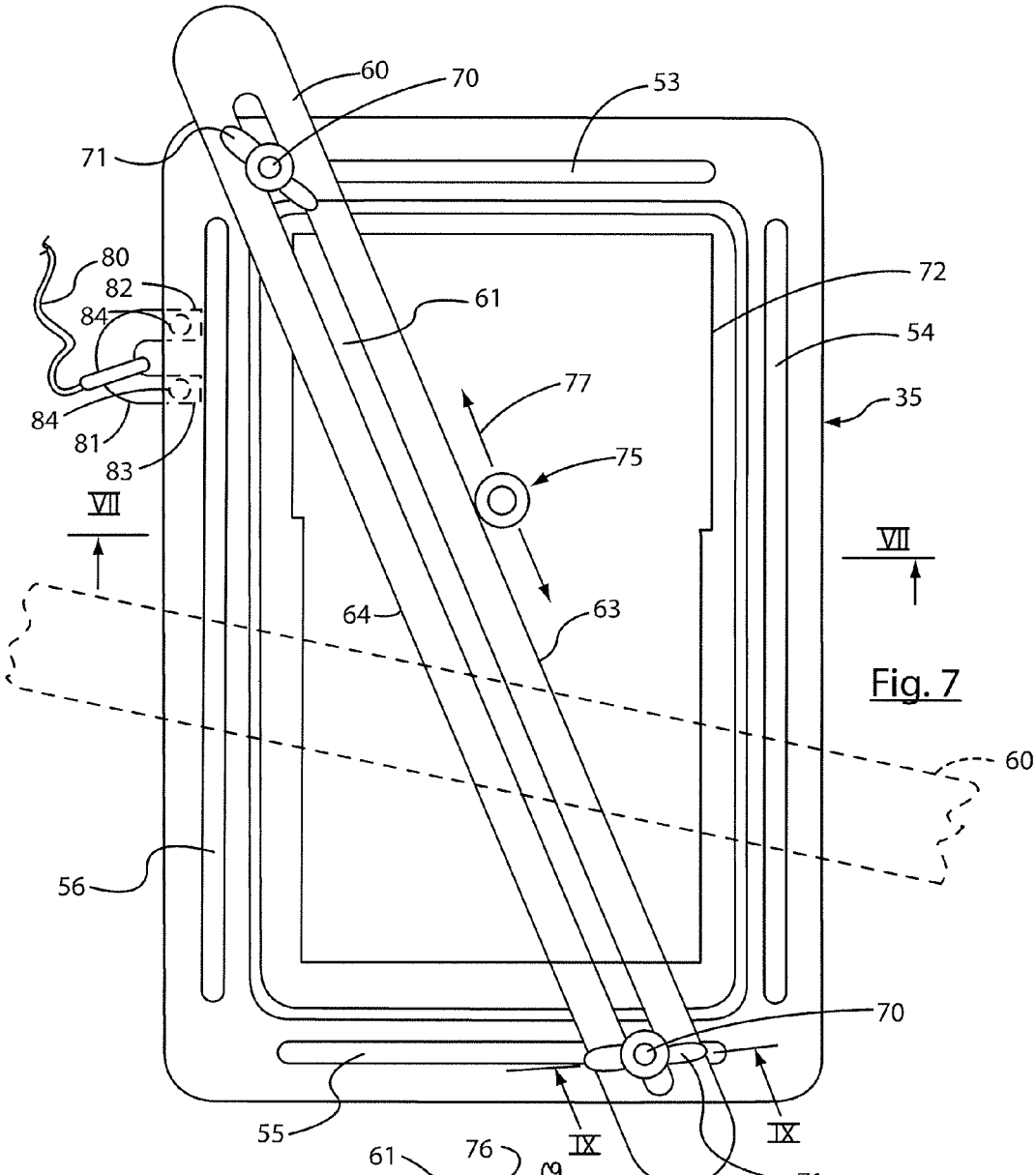
FIG. 7 is a top view of the jig in accordance with this invention, wherein the clamping bar is clamped to the table of FIG. 2, with a synthetic shingle being in clamped relation between the table and the clamping bar.
Figure 8:
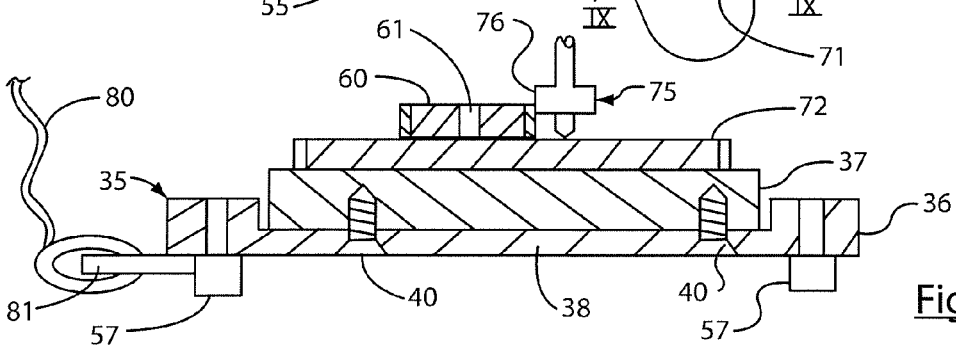
FIG. 8 is a transverse sectional view taken through the jig of FIG. 7, generally along the line VIII-VIII of FIG. 7, and wherein a cutter is fragmentally illustrated, for sliding along an edge of the clamping bar, for cutting the clamped shingle.

With reference to FIGS. 7 and 8, it will be seen that the clamping bar is clamped to the table 35 by means of suitable fasteners, such as carriage bolts 70 passing through a plurality of the elongate slotted holes 53, 54, 55 or 56, and through the elongate slotted hole 61 in the clamping bar 60, clamping a shingle or tile 72 between the clamping bar 60 and the insert 37 of the table 35.

It will thus be seen that a cutting tool 75 may then be employed to cut the shingle or tile 72, by sliding a guiding portion 76, along an edge such as that 63 of the clamping bar 60, and moving the same parallel to that edge, in the direction of the double headed arrow 77 illustrated in FIG. 7.

The cutting tool 75 may be of any type, but it has been found that a cutting tool with a rotating cutter operates very well with the jig of this invention. Such a cutting tool may be constructed for example, in accordance with any U.S. Pat. Nos. 5,143,490; 5,323,823; 5,813,805; 5,902,080; and 6,048,260.

Shingles or tiles that are to be cut in accordance with this invention will preferably be synthetic shingles or tiles, and may for example be constructed in accordance with U.S. Pat. No. 6,808,785, the complete disclosure of which is herein incorporated by reference. The process for making such shingles or tiles may include the processes set forth in U.S. Pat. Nos. 7,141,200 and/or 7,141,201, the complete disclosures of which are likewise herein incorporated by reference.

With reference to FIG. 7, it will also be seen that the bar 60 may be set at any angle, and may be clamped to the table via any of the slotted holes 53, 54, 55 and 56. For example, the bar 60 is also shown in phantom, and is fragmentally illustrated in FIG. 7, to be clamped across the table in a somewhat horizontal position, as shown. It will be apparent from the foregoing that with the jig of this invention the cutting tool 75 may be guided through an infinite number of angular positions of the clamping bar, for guiding a cutter along the clamping bar for cutting a clamped shingle or tile in any of an infinite number of angular cuts, as may be desirable depending upon the cut needed to accommodate the placement of a given shingle or tile on a roof. Such cuts can include not only cutting pieces for valleys, but for cutting pieces at ends of courses, in making starter shingles, etc., or for any other purpose.

The base 36 of the table of this invention will preferably be constructed of a high impact plastic, as would be the bar 60, preferably with metal edges 63, 64 for the clamping bar 60.

With further reference to FIGS. 7 and 8, it will be seen that a metal loop 81 is provided, having legs 82 and 83, that are fastened by means of screws 84 or the like, to the undersurface of the base 38, along the left side thereof, as shown, with the loop 81 providing means for attachment of a leash 80. The leash 80 can be of any given length, and is provided as a safety mechanism, whereby the leash can be tied to some portion of a roof, such as, but not limited to, a chimney, so that, especially when the jig of this invention is to be used on a sloped roof, the leash can attach the jig to the roof, so that the jig cannot fall from the roof during use. The leash 80 and its attachment 81 may be used also on a flat roof, as may be desired, as a similar safety feature.

The preferably rubber pads or feet 57, in addition to having anti-slip qualities to maintain the jig on a sloped roof, can also prevent the jig from moving around during use. It will be noted that the pads or feet 57 are of a sufficient height that they allow the head of the fastener 70 illustrated in FIG. 9 to be spaced above the roof or other surface on which a jig is to be disposed, to allow the fastener 70 to slide along the elongate slotted hole in which it is mounted, such as the elongate slotted hole 36.

Figure 9:
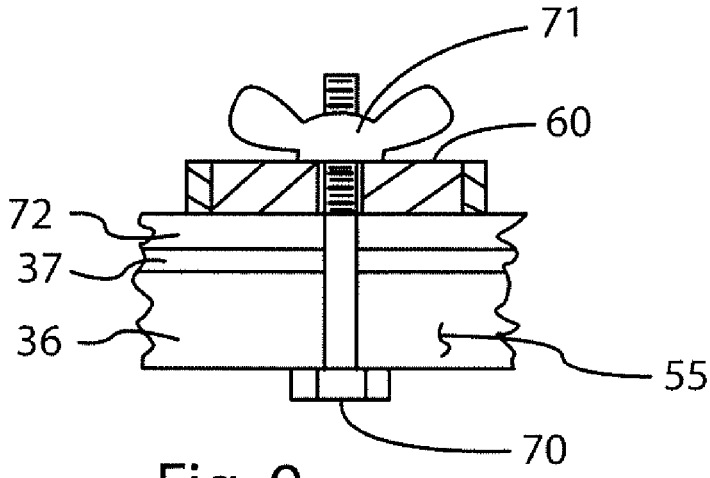
FIG. 9 is a transverse sectional view, taken through the clamping bar and table in accordance with this invention, generally along the line IX-IX of FIG. 7.
Figure 10:
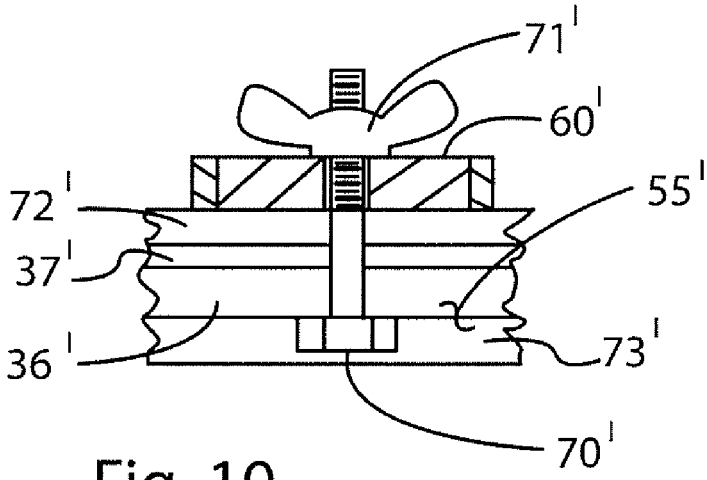
FIG. 10 is a view similar to the illustration of FIG. 9, but wherein elongate slots through the table are enlarged at the lower end of the table, adjacent the bottom surface thereof, for countersinking the heads of fasteners that are used to clamp a shingle that is being cut between the table and the elongate bar.

With reference to FIG. 10, an alternative is provided to the arrangement of FIG. 9, in which the slotted hole 55 illustrated in FIG. 7 is numbered as 55' and has its lowermost portion 73' enlarged so as to allow the head of the fastener 70' to be countersunk, so that it does not protrude below the bottom surface of the table 35. In this arrangement, the feet or pad 57 illustrated in FIG. 8 could be shorter in the vertical direction. In FIG. 10, the clamping bar is numbered 60', the wing nut is numbered 71', the frame is numbered 36', the insert is numbered 37', and the shingle is numbered 72', such numbers corresponding to similar components of FIG. 9 not having the prime following their numbers.

It will thus be apparent from the foregoing that the jig in accordance with this invention may be made in any of various sizes and forms, and of various materials, all within the spirit and scope of the invention as defined in the appended claims.

What is claimed is:

1. A jig for use in cutting synthetic shingles and tiles while the jig is disposed on a supporting surface, comprising;

(a) a table having an upper supporting surface for receiving and supporting a synthetic shingle or tile thereon;

(b) the table having a plurality of sides terminating in edges;

(c) a plurality of elongate slots in the table, generally parallel to said edges and having a lower surface for disposition onto a supporting surface;

(d) an elongate clamping bar having at least one longitudinal slot therein;

(e) a plurality of fastener means for fastening the elongate bar to the table by the fasteners extending through the at least one longitudinal slot in the clamping bar and through elongate slots in the table, when a shingle or tile is in clamped relation between the elongate bar and the table;

(f) whereby the at least one elongate slot in the clamping bar and the elongate slots in the table comprise means for slideably adjustably clamping the clamping bar to the table with a shingle or tile therebetween, in an infinite number of selected angular positions of the clamping bar, for guiding a cutter along the clamping bar for cutting a clamped shingle or tile in any one or more of an infinite number of angular cuts;

(g) wherein the table comprises a table frame having a removable insert that has the upper supporting surface thereon;

(h) wherein the frame has an upper surface and wherein the upper surface of the insert protrudes above the upper surface of the frame; and (i) including a safety apparatus comprising means for attaching the jig to a root, during use.

2. The jig of claim 1, wherein the insert is removably connected to the frame by fasteners.

3. The jig of claim wherein the fastener means of clause (e) comprise threaded fasteners with wing nuts thereon.

4. The jig of claim 1, wherein the table has a lower surface, including a plurality of slip resistant pads on its lower surface.

5. The jig of claim 1, wherein the elongate clamping bar has a metallic edge for guiding a cutter therealong, for cutting a shingle or tile.

6. The jig of claim 1, wherein the insert is removably connected to the frame by fasteners, wherein the frame has an upper surface and wherein the upper surface of the insert protrudes above the upper surface of the frame, wherein the fastener means of clause (e) comprise threaded fasteners with wing nuts thereon, wherein the frame has a lower surface, including a plurality of slip resistant pads on its lower surface and wherein the elongate clamping bar has a metallic edge for guiding a cutter therealong, for cutting a shingle or tile.

* * * * *

UNITED STATES PATENT AND TRADEMARK OFFICE

CERTIFICATE OF CORRECTION

PATENT NO. : 7,987,604 B2
APPLICATION NO. : 12/619967
DATED : August 2, 2011
INVENTOR(S) : Daniel Max Zernec It is certified that error appears in the above-identified patent and that said Letters Patent is hereby corrected as shown below:

Column 6, line 3, reads "3. The jig of claim wherein the fastener means of clause (e)"
should read -- 3. The jig of claim 1 wherein the fastener means of clause (e) --
(This is claim 3.)

Signed and Sealed this
Thirteenth Day of September, 2011

David J. Kappos

David J. Kappos
*Director of the United States Patent and Trademark Office*